United States Patent [19]

Oka et al.

[11] Patent Number: 4,794,062

[45] Date of Patent: Dec. 27, 1988

[54] METHOD FOR THE FORMATION OF OUTLINE IMAGES CORRESPONDING TO THE PERIPHERAL OUTLINES OF DOCUMENT'S IMAGES

[75] Inventors: Tateki Oka, Toyokawa; Naoki Toyoshi, Toyohashi; Tomoaki Yokoyama, Toyokawa, all of Japan

[73] Assignee: Minolta Camera Kabushiki Kaisha, Osaka, Japan

[21] Appl. No.: 16,716

[22] Filed: Feb. 19, 1987

[30] Foreign Application Priority Data

Feb. 21, 1986 [JP] Japan ..... 61-37830
May 2, 1986 [JP] Japan ..... 61-102587
Sep. 19, 1986 [JP] Japan ..... 61-223247

[51] Int. Cl.[4] ..... G03G 13/02; G03G 21/00

[52] U.S. Cl. ..... 430/31; 355/3 CH; 355/14 CH; 430/902

[58] Field of Search ..... 355/3 R, 3 CH, 14 CH; 430/31, 902

[56] References Cited

U.S. PATENT DOCUMENTS 3,883,349 5/1975 Sato ..... 355/3 X
3,950,680 4/1976 Michaels et al. ..... 355/3 X
3,967,891 7/1976 Rippstein ..... 355/3 R
4,141,648 2/1979 Gaitten et al. ..... 355/3 X
4,634,259 1/1987 Oishi et al. ..... 355/3 X

FOREIGN PATENT DOCUMENTS 51-134635 11/1976 Japan .
54-30833 3/1979 Japan .

*Primary Examiner*—Fred L. Braun
*Attorney, Agent, or Firm*—Wenderoth, Lind & Ponack

[57] ABSTRACT

A method for forming an outline of an image. In this method, at first, an electrostatic latent image bearing member is charged and then irradiated to a positive image to form an electrostatic latent image. Thereafter, the irradiated member is re-charged with a scorotron charger while applying a voltage to a grid, the voltage being lower than the surface potential of the image portion of the latent image, being slightly higher than the background potential of the latent image and being of the same polarity as that of the original charging. By this re-charging, the outline portion of the image is given higher potential than the other portion. Then, the outline portion of the image with higher potential is subjected to a normal development by using a toner charged to a polarity opposite to the polarity of the recharged portions.

8 Claims, 4 Drawing Sheets

METHOD FOR THE FORMATION OF OUTLINE IMAGES CORRESPONDING TO THE PERIPHERAL OUTLINES OF DOCUMENT'S IMAGES

BACKGROUND OF THE INVENTION

1. Field of the Invention

This invention relates to an outline image forming method which constitutes one image forming processes relying upon the electronic photo-copying technology. More specifically, it relates to a method for the formation of outline images corresponding to peripheral outlines of positive document's images, and at the inside thereof.

2. Description of the Prior Art

Generally speaking, the peripheral outline of an image is in practice full of necessary information thereabout and represents sufficiently the characterizing features of the given image, thus playing among others a most important role in the judgement of the latter.

The outline image so-called means such that a peripheral outline is picked up from a generally full and positive documentary image and is devoid of intermediate tones or reversely, solid representations, thus being most effective for the identification of the practical image and for pattern recognization purpose thereof.

As an example, a complex color image pattern may be attractive to obtain by execution of twice successive copying operations to form a blank pattern encircled by a color outline, or to prepare a blank pattern for later producing differently colored local image areas contained therein.

It should be noted that in the name of the present assignee company, it has already been proposed to provide an outline image-forming process, wherein, in case a mono-component type toner developing method using conductive toner to develop static latent images, said process is characterized by that, between the material to be subjected to developing and the carrier for the conductive toner, a d.c.-bias voltage is impressed at a medium potential ranged between the maximum and minimum surface potential of said material and having an opposite polarity to the static latent image charge, for extracting the outline marginal configuration only from the latent image on said material to be developed (refer to Japanese Laid Open Patent Specification, unexamined, No. Sho-51-134635).

It should be further noted, however, that there is a considerable drawback in the above-mentioned prior art improvement. In this proposed process, indeed, the developed marginal outline image is only a negative one, because of the fact that the marginal outline of the static latent image is also negative and the conductive toner will be deposited onto a substantial part of the latent image devoid of the marginal outline thereof, and indeed, by virtue of higher potential difference charged at the substantive part of the latent image on the drum. In practice, however, the wanted marginal outline should preferably be in black and thus be positive. Therefore, the thus formed negative outline image must generally be subjected to a further reproducing step relying upon the reverse development principle, which represents naturally a grave and troublesome drawback inherent in the above known process.

SUMMARY OF THE INVENTION

It is, therefore, a main object of the present invention to provide a still further improved method for producing a sharp and clear, blurless outline image.

Another object is to provide a unique outline image forming method in accordance with which the toner is deposited along the inside of the peripheral outline of the latent image corresponding to the positive document's image, relying upon the normal and regular developing technique, so as to make the outline image visible, and thus to produce a high quality outline image.

Still further objects will become apparent as the description proceeds.

For fulfilment of these and further objects, a preferred mode of the present invention comprises:

- a first charging step for applying an electric charge of a predetermined potential level onto the surface of a static latent image carrier member, preferably a photo-sensitive drum;
- an exposed step for exposure of positive image or images onto the surface of said static latent image carrier member upon execution of said first charging step;
- a second charging step for recharging the surface of said member after execution of said exposure step and by applying an electric voltage at a lower potential level than that prevailing at the static latent image or images formed in the foregoing exposure step, and having the same polarity as the charge used in said first charging step, through grid means by a scorotron charger; and
- a developing step for normally developing the static latent image formed in said second charging step, by the use of charged toner of the opposite polarity to that used in said first charging step.

BRIEF DESCRIPTION OF THE DRAWINGS

In the following description, like parts are designated by like reference numerals throughout the several drawings.

PREFERRED EMBODIMENTS

In the following, a preferred first embodiment of the inventive outline image-forming method will be set forth with reference to the drawings.

Figure 1:
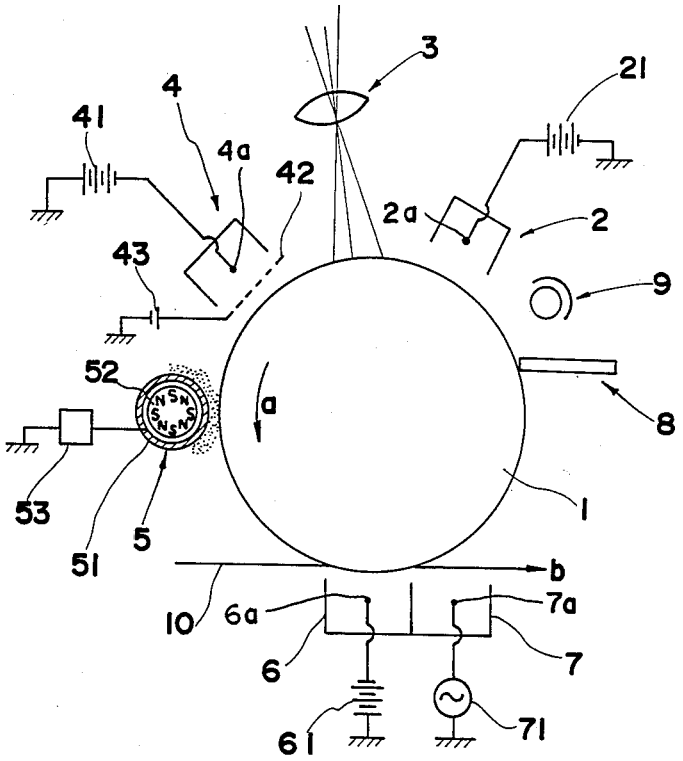
FIG. 1 is a schematic elevation of a first preferred embodiment of an electrostatic photocopier adapted for execution of the inventive method for forming peripheral outline images in a unique manner.

FIG. 1 illustrates only schematically an electronic photocopier adapted for carrying out the process according to the invention.

Numeral 1 shows a photosensitive drum, having an optoelectrical sensitive layer on the cylindrical surface, as is conventional. The rotational direction is shown by a small arrow "a". Several units and apparatuses are provided, as will be more specifically set forth hereinbelow.

Numeral 2 designates a static charger, having a charging wire 2*a* electrically connected to a battery 21, the negative pole thereof being earthed as shown. This charger 2 is adapted for execution of the first charging, so as to charge the drum surface layer to a certain predetermined static potential level.

Numeral 3 designates only schematically an exposure apparatus adapted for forming static latent images, corresponding to original or document images, onto the drum surface by utilization of a conventional slit exposure system, and comprises an exposure lamp, mirror, lens and the like constituents. In FIG. 1, the exposure apparatus 3 is shown only schematically and representatively by a projecting condenser lens.

Numeral 4 designates a second or "scorotron"-charger, which is adapted for execution of a second charging of the surface of drum 1 after the formation of latent images thereon, as was set forth hereinbefore. The second charger 4 is provided with a charge wire 4*a* connected to a battery 41, the positive pole thereof being earthed as shown. A grid 42 of the second charger 4 is provided which is connected with a separate battery 43, the negative pole thereof being earthed as shown. Charge wire 4*a* is impressed from the battery 41 with a voltage of reverse polarity with respect to that prevailing at the static charger 2. Grid 42 is impressed from battery 43 with a substantially lower voltage than the surface potential prevailing at the static latent image area(s) on the drum 1, said voltage having the same polarity as that prevailing at the static charger 2. It should be noted further that the voltage impressed at the grid 42 must be only somewhat or slightly higher than the surface potential prevailing in the background areas devoid of the static latent image area(s) on the drum.

Numeral 5 designates generally a developer comprising a developing sleeve ring 51 or cylinder and a magnet roller 52 fixedly mounted in said ring or cylinder and having a number of alternating N- and S-poles at its periphery. The said developer is capable of operating according to the known magnetic brushing principle. The developing sleeve ring 51 can also operate as developing electrode means, a developing and biasing voltage source 53 being electrically connected to said sleeve. As the developing agent, there is preferably used a mixture of magnetic carrier and insulative toner which have been statically charged with mutually opposite polarities through a frictional charging step. Further, the insulative toner is charged to have an opposite polarity to that of static charger 2 by the said friction charging step.

If the used insulation toner is non-magnetic, developer sleeve 51 is impressed from voltage source 53 with a developing bias somewhat higher than the grid voltage and of the same polarity as static charger 2.

If desired, however, the insulative toner may be magnetic. In this case, developer sleeve 51 may be impressed with a bias voltage at a lower level than the surface potential prevailing at the middle portion of the static latent image area(s) per se, which surface potential has been lowered in the second charging step.

As an alternative measure, there may be used a developing bias on which has been superposed an a.c.-voltage. In the case of magnetic toner, insulative toner only may be used.

Numeral 6 designates a transfer charger, which is so designed and arranged as to impress onto a copy paper 10 being conveyed as shown by a small arrow "b" an electrical field from the rear side of the paper, as to transfer the toner image(s) on the surface of sensitive drum 1 under the action of developer unit 5. For this purpose, charger 6 is fitted with a charge wire 6*a* which is connected with a battery 61, the negative pole of the latter being earthed as shown. In this way, the charge wire 6*a* is impressed with a voltage with a reverse polarity to that of the insulative toner.

Numeral 7 designates a separation charger, which is adapted for impressing an alternating electrical field on the copy paper directly upon execution of said transfer step, for the purpose of removing residual charge therefrom, so as to separate the paper from the surface of drum 1. For this purpose, charge wire 7*a* of the charger 7 is fed with an alternating voltage from a current source 71.

Numeral 8 designates a cleaner unit adapted for removing residual toner from the drum surface by a so-called blade system known to those skilled in the art.

Numeral 9 designates an eraser lamp adapted for removal of residual charges from the drum surface through opto-projection and for making the drum surface ready for execution of the next succeeding photocopying cycle.

In the following, only by way of example, polarities and impressing or impressed voltages with relation to several chargers and the like, as used in the present embodiment, will be set forth.

| | |
|---|---|
| (I). When using non-magnetic insulative toner: | |
| static charger (voltage source 21) | positive, +5.5 kV |
| scorotron charger (voltage source 41) | negative, −6.0 kV |
| grid (voltage source 43) | positive, +200 V. |
| distance between grid and drum (dg) | 1.5 mm |
| developing bias (voltage source 53) | positive, +300 V. |
| transfer charger (voltage source 61) | positive, +5.5 kV |
| insulative toner | negative |
| (II). When using insulative and magnetic toner: | |
| static charger (voltage source 21) | positive, +5.5 kV |
| scorotron charger (voltage source 41) | negative, −6.0 kV |
| grid (voltage source 43) | positive, +200 V |
| distance between grid and drum (dg) | 1.5 mm |
| developing bias (voltage source 53) | positive (d.c.), +170 V a.c., 350 V rms, 1 kHz, |
| starting potential for development | +250 V |
| insulative- and magnetic toner | negative |

It should be noted that the above mentioned polarities may be all reversed. Voltage values set forth above are naturally given only by way of example and thus may be varied as the occasion requires.

The method for the formation of a marginal outline image by the use of the foregoing copier machine will be set forth stepwise hereinbelow.

(i) First charging step

A static charge at a predetermined potential level is applied evenly on the sensitive drum 1 by static charger 2. As a result, the surface potential of drum 1 will rise to +600 V.

(ii) Exposure step

Figure 3:
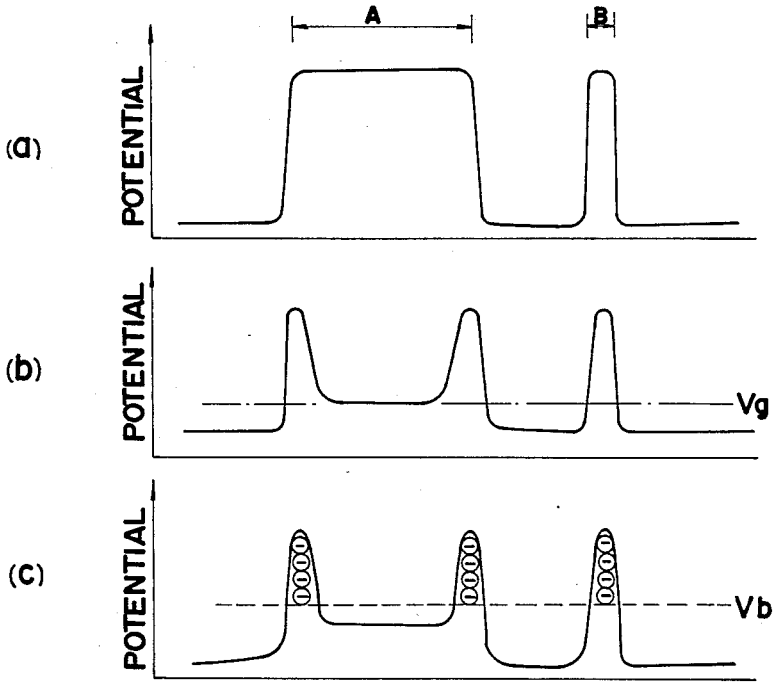
FIGS. 3(*a*), 3(*b*) and 3(*c*) are charts showing electric potentials appearing in several steps in the method according to the invention.

Original document images are exposed onto the drum surface charged to +600 V in the foregoing step. The exposure may be carried into effect conventionally by a slit exposure means, so as to form the corresponding static latent images thereon. In this case, as shown in FIG. 3 at (a), the charge remaining at image areas "A" and "B" amounts to +600 V-potential, while the charge existing in unimaged or blank areas devoid of the image is reduced to +100 V or so. Naturally, the document images are positive.

(iii) Second charging step

A charge of opposite polarity to that of the static latent images is applied by the scorotron charger 4 onto the drum surface, on which the latent images have been provided in the foregoing step. In this instant, grid 42 is impressed with a voltage of +200 V. The charge at scorotron charger 4 is of reverse polarity to that used in the first charging step, while the voltage as applied to the grid 42 is substantially lower than that prevailing at the static latent image areas, +600 V, and of the same polarity as was used in the first charging step. Additionally, the voltage impressed upon grid 42 is slightly higher than the surface potential, +100 V, in the non-imaged blank area portions on the drum.

Figure 2:
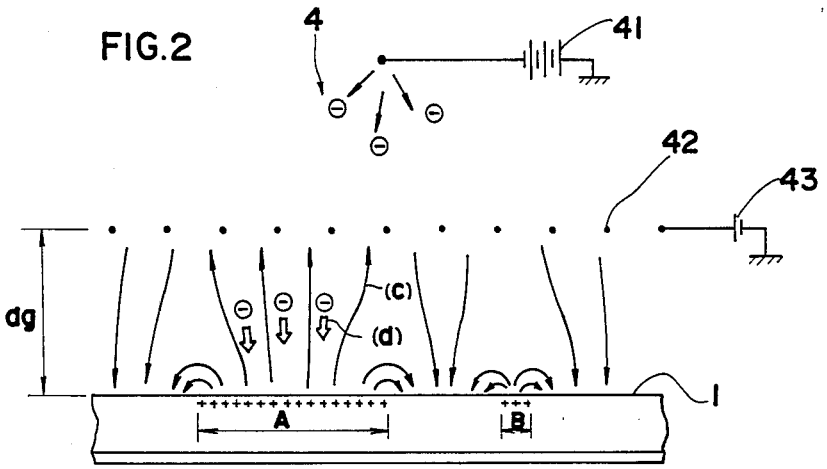
FIG. 2 is a schematic diagram of electric lines of force appearing in the first embodiment at the second charging step.

As a result, lines of electrical force as shown by arrows (c) in FIG. 2 appearing between the drum surface and the grid are created, and negative ions issuing from the related charge wire will receive conveying forces along such lines of force. In this case, the lines of force accelerating the negative ions, in proximity of the grid 42 towards the drum surface at 1, are only effective in the substantive imaged portions devoid of peripheral outlines of the image areas "A" and "B". Therefore, the negative ions can arrive exclusively at the substantive portions defined by and devoid of marginal outlines of the imaged areas (A); (B), as shown by small arrows (d). In this way, the potential of the ion-impinged substantive areas will be lowered nearly to a value substantially the same level as the grid potential, +200 V. In other words, with reference to the corresponding drum surface potential differentials thereby formed, referring to FIG. 3(*b*), the surface potential at the imageless background portions will be left at a lower potential level nearly equal to +100 V. On the other hand, the inside strip-like zone, when seen in plan, residing at the inside of the marginal outline at imaged area "A" and existing therealong, as well as line-like slender imaged portion "B", each having a substantial constant width, will remain substantially at a constant and high level, +600 V, which corresponds to the initial surface potential, while the potential at the central portion of imaged area "A" will be reduced to that equal to the grid voltage (Vg: +200 V) or so. Additionally, the slender, line-like imaged portion "B" is not subjected to surface potential reduction, while the width of the charged zone will be somewhat reduced. In other words, outlines of the imaged areas "A" and "B" are said to have been formed as positive latent images.

(iv) Developing step

In the present second charging step, the thus formed positive outline images are further subjected to the presently employed developing step under the action of developer unit 5. When the insulative toner is non-magnetic, the developer sleeve 51 is impressed with a developing bias of +300 V, as an example. This developing bias voltage, Vb, is selected to be somewhat higher than the grid voltage, Vg, +200 V, as an example, and higher than the substantively imaged area potential at "A" which has been caused to lower to such a value to be substantially equal to the grid voltage, Vg, and having the same polarity as was employed in the first charging step, and indeed, for the purpose of preventing superfluous and fouling toner-deposition, not only in the imageless background areas, but also at imaged areas, surface potentials in these areas having been caused to lower considerably in the second charging step, as was referred to hereinabove.

On the contrary, when the insulative toner is magnetic, the developing sleeve 51 is impressed with a.c. −350 V, 1 kHz, plus d.c.-plus 170 V, as a developing bias.

This developing bias voltage, Vb, is selected to be somewhat lower than the grid voltage, Vg: 200 V, thus being lower than the potential level at the substantive part of the imaged area "A", the latter potential having been lowered precisely or nearly to the grid voltage, Vg. With the use of magnetic toner, however, a certain threshold value may exist on account of the very existence of magnetically binding action, and the development will normally start at +250 V or so of the surface potential.

Under this operating condition, there is no fear of superfluous and fouling deposition of the toner on the substantive part of the statically formed latent image areas as well as the imageless background areas, wherein the potential levels thereat have been caused in the second charging step to be considerably lowered.

Under these operating conditions, and as shown in FIG. 3(*c*), the negatively charged insulative toner particles will be deposited onto the higher potential regions on the drum surface, or more specifically, exclusively onto a slim inside edge portion of each of the marginal outline portions around the inside of the edge of the imaged areas "A" and "B", whereby a kind of tonered "embroidering" inside edge lines are formed upon execution of a regular and normal development. Then, these tonered images are transferred onto the copy paper 10 upon execution of negative discharge at transfer charger 6 and then subjected to fixing at a conventional fixing unit, not shown, to provide corresponding photo-copied images.

By calling for the grid voltage to be substantially lower than the first charging voltage is meant that the grid voltage, Vg, must be enough lower than the surface potential at the static and latent-imaged areas such that in the second charging step, the surface potential at substantive part of the latent image areas is kept at a level sufficiently low relative to the said surface potential so that development of only the edge portions of the image can be achieved by the use of the developing voltage Vb.

(III). A slightly modified example from that set forth hereinbefore, and using non-magnetic insulative toner the same as used in the first embodiment, and in which the operating conditions of the scorotron charger 4 have been changed, will be described. In this case, the following operating items have been modified from those as set forth at the foregoing example (I), although non-magnetic insulative toner has been employed.

--- scorotron charger (voltage source 41) negative, −7.0 kV

-continued

| | |
|---|---|
| grid (voltage source 43) | positive, +300 V |
| distance between grid and drum (dg) | 1.0 mm |
| developing bias (voltage source 53) | positive, +250 V. |

In this modification, the charging performance of the scorotron charger 4 is higher than before, the potential of the imaged area "A" will fall to +230 V or so. The developing bias voltage, Vb, has been set to +250 V which is lower than grid voltage, Vg, or 300 V. On the other hand, it is higher than the said lowered surface potential +230 V so that, superfluous and fouling deposit of the toner onto substantive parts of the static latent-imaged area can be positively prevented.

Figure 4:
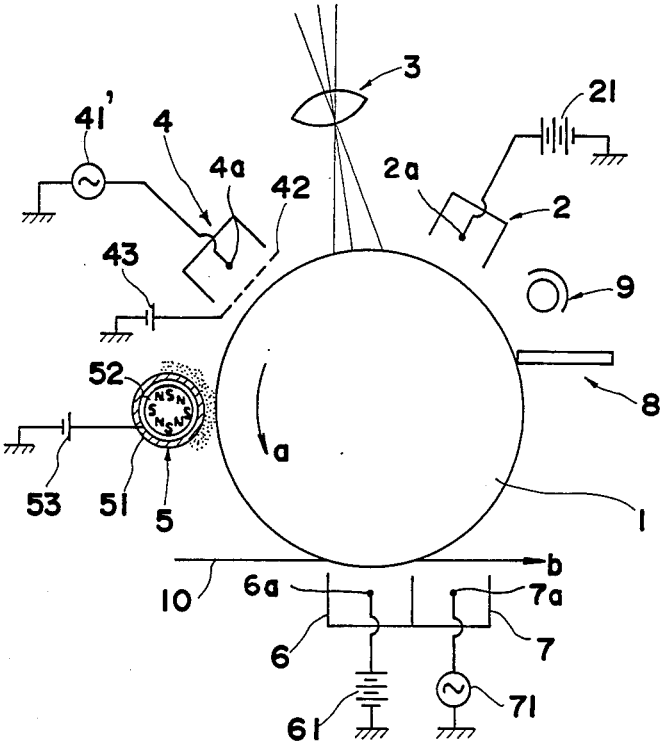
FIG. 4 is a similar view to FIG. 1, showing, however, a second embodiment.
Figure 5:
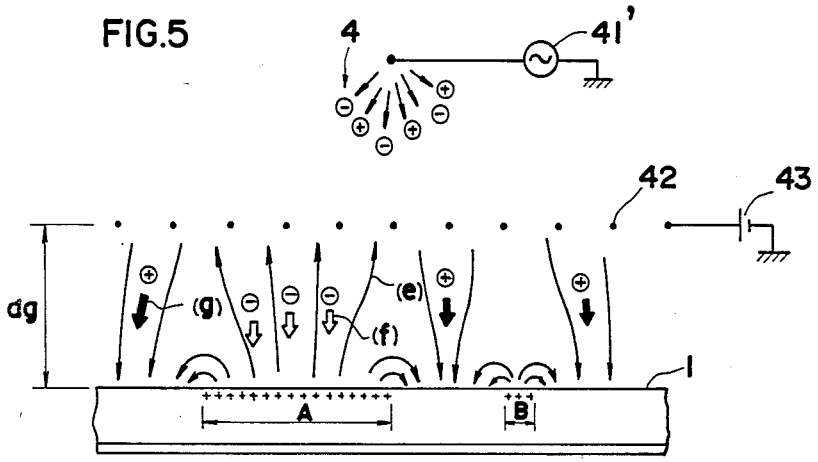
FIG. 5 is a similar view to FIG. 2, showing, however, the lines of force for the second embodiment, and FIGS. 6(*a*), 6(*b*) and 6(*c*) are views similar to the parts of FIG. 3, showing, however, the charts of electric potentials in the second embodiment.

Next, a second embodiment of the invention will be set forth. The difference of the second embodiment from the first is that scorotron charger 4 is impressed with an a.c.-voltage from current source 41' in place of source 41. FIG. 4 corresponds to FIG. 1; FIG. 5 to FIG. 2; and FIG. 6 to FIG. 3, respectively.

More specifically, scorotron charger 4 executes second charging of the drum surface on which the static latent images have been already formed. The charge wire is connected with a.c.-source 41', while grid 42 is connected with voltage source 43. The charge wire is impressed with alternating voltages from the voltage source 41'. On the other hand, grid 42 is impressed from voltage source 43 with a voltage substantially lower than the surface potential at the imageless background areas and having same polarity as static charger 2, in the same way as in the first embodiment. It is necessary that the voltage impressed on grid 42 is higher than the surface potential at the static latent image areas, the potential thereat having been lowered considerably under the action of exposure unit 3.

Polarities and voltages of the several chargers and the like constituents appearing in the present second embodiment are similar to those which were adopted in the foregoing first embodiment. However, it should be noted that the voltage of the source 41' for scorotron charger 4 is specified to be a.c.-plus/minus 6.0 kV when the insulative toner is non-magnetic. With use of magnetic insulative toner, the voltage may be the same as above which means a.c.-plus/minus 6.0 kV.

The marginal outline formation process according to the present embodiment will be stepwise set forth hereinbelow.

(i) First charging step

The surface of sensitive drum 1 is impressed with electrical charge at a predetermined constant level under the action of static charger 2. In the present second embodiment, the drum surface potential is set also to +600 V.

(ii) Exposure step

Figure 6:
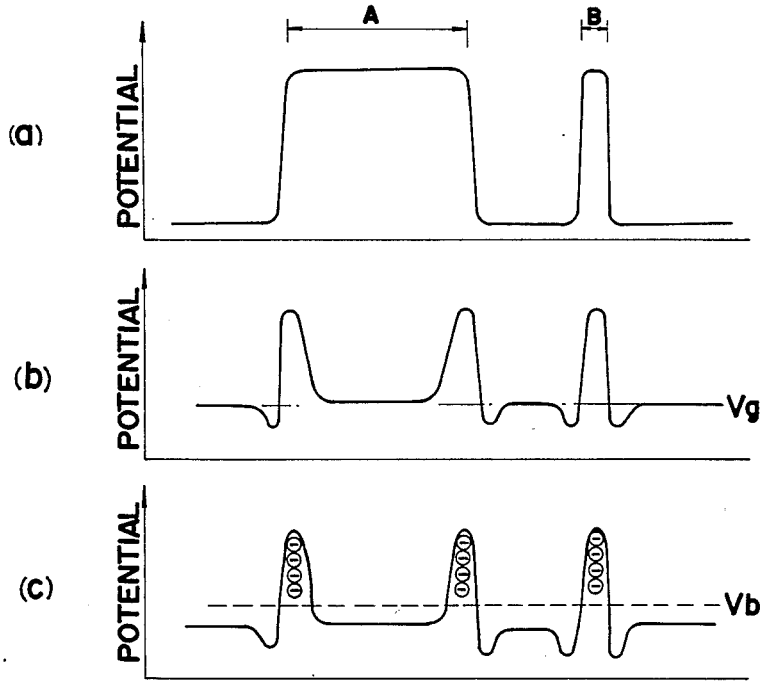

Then, document's images are exposed and projected onto the thus charged drum surface by the slit exposure system as conventionally, for providing the corresponding static latent images. As shown in FIG. 6(*a*), the static charge at the imaged areas "A" and "B" remains at +600 V, while that of the imageless background areas will be reduced to +100 V or so under the influence of the light projection. As the document's images, positive ones may be used the same as in the foregoing first embodiment.

(iii) Second charging step

The drum surface with static latent images from the foregoing step is subjected to a recharging step by the use of scorotron charger 4, impressed with alternating voltages. At this time, grid 42 is charged with a voltage of +200 V from voltage source 43. This voltage impressed on grid 42 is substantially lower than the surface potential, +600 V, in the static latent image areas "A" and "B" and somewhat higher than surface potential, 100 V, in the imageless background areas, said voltage being, however, of same polarity as that in the first charging step.

Between the drum surface 1 and the grid 42, lines of electrical force as schematically shown by arrows (e) in FIG. 5 are present. Negative and positive ions issuing from the charge wire impressed with alternating voltages are subjected to conveying forces along these lines of electric force. In this case, the effective lines of force for accelerating negative ions in the proximity of grid 42 towards the drum surface are only those which exist at substantive part of the imaged areas devoid of and at the inside of the peripheral outline of these imaged areas "A" and "B". Therefore, these negative ions, as shown by double-lined arrows (f) in a similar manner to the foregoing first embodiment, impinge exclusively upon substantive parts of the imaged areas "A" and "B" devoid of inside peripheral zones of these imaged areas, as an example. As a result, the static potential level at these ion-impinged imaged areas will be caused to fall to a lower level which corresponds substantially to the grid voltage, +200 V.

On the other hand, the positive ions will go ahead, as shown by thickened small arrows (g), towards the imageless background areas other than the outline portion of imaged area "A" for elevating the prevailing electrical charges thereat, whereby the corresponding potential increases to a level nearly equal to the grid voltage, +200 V.

In other words, when more specifically describing the operation in terms of drum surface, the potential prevailing at an inside periphery along the imaged area at "A" and imaged area "B" remains at an initial high potential level substantially equal to +600 V and with a substantially constant width, while the potential at a substantive part of the imaged area "A" is lowered to a potential level substantially equal to the grid voltage, Vg: +200 V.

On the contrary, the imageless marginal portions remain at a certain lower potential level, nearly +100 V, while at other imageless portions, the potential will rise to nearly the grid voltage, Vg: 200 V. The surface potential at the other strip-shaped image portion "B" will show almost no reduction, the width of the charged portion being subjected to a certain size reduction.

At the conclusion of the execution of the second charging step, the peripheral outlines of these imaged areas "A" and "B" will be formed in the shape of statically positive latent images, which is desirable in the case of the present second embodiment.

(iv) Developing step

The static latent images formed in the foregoing second charging step and in the form of positive images, will be subjected to a developing step by the action of developer unit 5.

The developing conditions and mechanism used in the present step are substantially similar to those which were used in the preceding first embodiment and thus can be omitted without detracting from a good understanding of the present invention.

As a conclusion, it should be noted that the surface potentials prevailing not only in the latent-imaged areas, but also in the imageless background areas, have been elevated considerably in the second charging step employed in the present invention, and indeed, for the positive prevention of otherwise conventionally possible superfluous and fouling toner deposition.

In this way, the negatively charged insulative toner is reliably deposited at higher potential portions of the photo-sensitive drum surface, or more specifically at the marginal outline portions around the inside of the edges of the substantive portions of imaged areas "A" and "B", whereby a kind of sharp and clear "inside-embroidering" toner images are effectively produced upon execution of the regular and normal development.

It will be clearly understood that according to the inventive principles, higher potential portions of the static latent images formed on the sensitive drum, corresponding to the inside peripheral outline portions, are the only portions on which the toner is deposited, while other portions consisting of imaged areas, as well as imageless background areas do not have the toner deposited thereon, thus providing sharp and clear copied reproduction of insidely marginal outlines of document images with amazing success.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for forming by photocopying an outline of an image, said method comprising:

a first step of charging an electrostatic latent image bearing member to a predetermined surface potential and charge polarity;

a second step of irradiating the charged electrostatic latent image bearing member to thereby form a positive electrostatic image thereon having an image portion with a surface potential corresponding to said predetermined surface potential and a non-image portion having a substantially lower surface potential;

a third step of recharging the thus irradiated electrostatic latent image bearing member with a scorotron charger for lowering the potential of the image portion other than an outline portion around the edge of the image portion for giving the outline portion a potential higher than the potential of the remainder of the image portion; and a fourth step of developing the electrostatic latent image formed in said third step with a normal development by using a toner charged to a polarity opposite to the first step of charging and a voltage higher than the potential of the remainder of the image portion.

2. A method for forming by photocopying an outline of an image, said method comprising:

a first step of charging an electrostatic latent image bearing member to a predetermined surface potential and charge polarity;

a second step of irradiating the charged electrostatic latent image bearing member to thereby form a positive electrostatic image thereon having an image portion with a surface potential corresponding to said predetermined surface potential and a non-image portion having a substantially lower surface potential;

a third step of charging the thus irradiated electrostatic latent image bearing member with a scorotron charger having a grid by applying a voltage to the grid with the same polarity as the polarity of the predetermined surface potential of said first step and a value lower than the surface potential of the image portion; and a fourth step of developing the electrostatic latent image formed in said third step with a normal development by using a toner charged to a polarity opposite to the first step of charging and a voltage higher than the potential to which the image portion has been lowered by the grid voltage of said third step.

3. A method for forming by photocopying an outline of an image, said method comprising:

a first step of charging an electrostatic latent image bearing member to a predetermined surface potential and charge polarity;

a second step of irradiating the charged electrostatic latent image bearing member to thereby form a positive electrostatic image thereon having an image portion with a surface potential corresponding to said predetermined surface potential and a non-image portion having a substantially lower surface potential;

a third step of recharging the thus irradiated electrostatic latent image bearing member with a scorotron charger having a grid by applying a voltage to the grid with the same polarity as the polarity of the predetermined surface potential of said first step and a value substantially lower than the surface potential of the image portion and slightly higher than the surface potential of the non-image portion of the electrostatic latent image formed by said second step for lowering the potential of the image portion other than around the inside edge of the image portion to a potential approximately equal to the voltage of said grid; and a fourth step of developing the electrostatic latent image formed in said third step with a normal development by using a toner charged to a polarity opposite to the first step of charging and a voltage higher than the potential to which the image portion has been lowered by the grid voltage of said third step.

4. A method as claimed in claim 3 wherein a voltage of a polarity opposite to the polarity of the first step is applied to said scorotron charger.

5. A method as claimed in claim 3 wherein an alternating current voltage is applied to said scorotron for raising the background potential of the electrostatic latent image to a potential approximately equal to the voltage of said grid.

6. A method for forming by photocopying an outline around the inside of an image, said method comprising:

a first step of charging an electrostatic latent image bearing member to a predetermined surface potential and charge polarity;

a second step of irradiating the charged electrostatic latent image bearing member to thereby form a positive electrostatic image thereon having an image portion with a surface potential corresponding to said predetermined surface potential and a non-image portion having a substantially lower surface potential;

a third step of recharging the thus irradiated electrostatic latent image bearing member with a scorotron charger having a grid by applying a voltage to the grid with the same polarity as the polarity of the predetermined surface potential of said first step and a value substantially lower than the surface potential of the image portion and slightly higher than the surface potential of the non-image portion of the electrostatic latent image formed by said second step for lowering the potential of the image portion other than around the inside edge of the image portion to a potential approximately equal to the voltage of said grid; and a fourth step of developing the electrostatic latent image formed in said third step with a normal development by using a non-magnetic toner charged to a polarity opposite to the first step of charging and a voltage slightly higher than the potential to which the image portion has been lowered by the grid voltage of said third step.

7. A method as claimed in claim 6 wherein a voltage of a polarity opposite to the polarity of the first step is applied to said scorotron charger.

8. A method as claimed in claim 6 wherein an alternating current voltage is applied to said scorotron charger for raising the background potential of the electrostatic latent image to a potential approximately equal to the voltage of said grid.

* * * * *